US005518022A

United States Patent [19]

Ziehm

[11] Patent Number: 5,518,022

[45] Date of Patent: May 21, 1996

[54] ASPIRATOR WATER CIRCULATION APPARATUS

[76] Inventor: Raymond G. Ziehm, 6650 S. Sheridan Blvd., Littleton, Colo. 80123-6854

[21] Appl. No.: 301,542

[22] Filed: Sep. 6, 1994

[51] Int. Cl.[6] ..... F16K 49/00

[52] U.S. Cl. ..... 137/15; 137/337; 137/895; 126/362

[58] Field of Search ..... 126/362; 137/895, 137/337, 15

[56] References Cited

U.S. PATENT DOCUMENTS

| | | | |
|---|---|---|---|
| Re. 25,037 | 9/1961 | Brazier | 137/895 |
| 773,687 | 11/1904 | Stevenson | 126/362 |
| 985,834 | 3/1911 | Parker | 126/362 |
| 1,109,682 | 9/1914 | Kassander | 417/187 |
| 1,321,235 | 11/1919 | McCann | 126/362 |
| 1,351,779 | 9/1920 | Mather | 392/474 |
| 1,404,365 | 1/1922 | Hackman | 126/362 |
| 1,730,736 | 2/1927 | Knudsen | 126/362 |
| 1,780,379 | 11/1930 | Durdin | 126/362 |
| 1,969,460 | 8/1934 | Glenn | 126/362 |
| 2,039,275 | 4/1936 | McGrael | 299/84 |
| 2,255,460 | 9/1941 | Weaver | 137/79 |
| 2,709,488 | 3/1955 | Rudnick et al. | 137/895 |
| 2,823,695 | 2/1958 | Coffin | 137/337 |
| 3,097,661 | 7/1963 | Lee | 137/335 |
| 3,412,757 | 11/1968 | Watts | 137/337 |
| 3,473,481 | 10/1969 | Brane | 103/262 |
| 3,556,124 | 1/1971 | Walton | 137/337 |
| 3,669,351 | 6/1972 | Meier | 237/19 |
| 3,929,153 | 12/1975 | Hasty | 137/337 |
| 4,142,515 | 3/1979 | Skaats | 126/362 |
| 4,236,548 | 12/1980 | Howard | 137/335 |
| 4,331,292 | 5/1982 | Zimmer | 237/19 |
| 4,424,767 | 1/1984 | Wicke et al. | 122/13 A |
| 4,638,944 | 1/1987 | Kujawa | 237/8 R |
| 4,713,525 | 12/1987 | Eastep | 219/308 |
| 4,936,289 | 6/1990 | Peterson | 126/362 |
| 5,129,034 | 7/1992 | Sydenstricker | 392/486 |
| 5,183,029 | 2/1993 | Ranger | 126/362 |
| 5,331,996 | 7/1994 | Ziehm | 137/14 |

FOREIGN PATENT DOCUMENTS

| | | | |
|---|---|---|---|
| 1480563 | 6/1969 | Germany | 137/895 |

*Primary Examiner*—A. Michael Chambers

[57] ABSTRACT

A water circulation apparatus to provide instant hot water to faucets remote from the heater in residential and small commercial buildings when water is periodically used in the building. The apparatus comprises a body containing an aspirator and a check valve, and provisions for installation in the water supply line to the heater and cold water faucets. It uses a small water return line from a tee installed in the hot water pipe near the remote faucet, to a connector on the water circulation unit, thereby establishing a circulation loop from the water heater, through the hot water pipe, the tee and return line, and through the water circulation unit back to the heater. The aspirator is a tapered bore in the body with a concentric nozzle positioned in the large end, and a low pressure tap located in the vicinity of the nozzle outlet. The check valve uses a neutrally buoyant poppet to minimize friction.

The unit is responsive to the user and is self regulating in that it causes water to flow in the circulation loop only when water is being used in the building. Water is conserved since there is no need to run water to waste awaiting hot water from the heater to reach the remote faucet. When the building is unoccupied, the unit is dormant, thus conserving heat that would be lost if the pipes were kept hot at all times. The unit needs no gas or electrical power, and operates with only one moving part.

4 Claims, 1 Drawing Sheet

ASPIRATOR WATER CIRCULATION APPARATUS

BACKGROUND

This invention relates to quickly providing and maintaining hot water to remote faucets in residential and small commercial buildings.

The issue being addressed is the waste of water and time running water down the drain while waiting for hot water from the heater to arrive at remote faucets. In installations with long pipe runs, such as ranch style homes, this can result in a wait of one to two minutes. Tests conducted on a typical ranch style home have shown a waste of 10 to 12 liters of water at each occurrence. In these days of water and energy shortages, the need to eliminate this waste has become more acute.

The requirement for a method to quickly provide hot water at remote faucets has long been known, with devices patented in the early years of the twentieth century. These and subsequent devices were not broadly accepted since they were too complex, their installation was difficult, or they did not function well. Methods to solve this problem have generally followed two different approaches; (1) water circulation systems that continuously or periodically circulate hot water from the heater to the remote faucet and back to the heater through a separate return line, and (2) auxiliary remote water heaters, either in the basement near the faucet, or under the counter at the sink.

One circulation approach is convective flow using sloping hot water supply and return pipes, as shown in U.S. Pat. No. 3,929,153 to Hasty, 30 Dec., 1975, U.S. Pat. No. 2,255,460 to Weaver, 7 May, 1940 and U.S. Pat. No. 3,097,661 to Lee, 16 Jul., 1963. These systems are functional, but are insensitive to user needs, circulating hot water at all times, even at night and when inhabitants are away. Sloping pipes are easily installed in new construction, but are difficult in existing buildings. The return pipe must be of a diameter essentially equal to the supply pipe since convective pressure is extremely low, and flow would be limited with a small return tube. Considerable heat is lost since the surface area of the return pipe is large and stays hot at all times. These systems also have a tendency to excessively heat the cold water pipe which causes a similar problem in the cold water system that they are intended to solve in the hot water system.

Pumps used for hot water circulation as shown in U.S. Pat. No. 3,669,351 to Meier and Carouge, 13 Jun., 1972 and U.S. Pat. No. 4,142,515 to Skaats, 6 Mar., 1979 are also functional, but require electrical power, wiring, motors, seals, switches, and timers or thermostats. They may be more suitable for large commercial buildings than residential applications. Pump operated systems controlled by timers are also insensitive to user needs resulting in wasted heat when hot water is not required. Since pumped circulation systems have many operating parts, reliability will be affected, and maintenance could be an issue. Due to their complexity, initial procurement and installation costs are also high. Operational cost will be experienced to power the pump motor, and noise from the pump may be objectionable to some people.

Auxiliary heaters as shown in U.S. Pat. No. 4,236,548 to Howard, 2 Dec., 1980 can be used to provide instant hot water to remote outlets, however the cost of initial procurement and installation is a significant drawback. They require connection to gas (and necessary vent stack) or electricity for their energy source. Operational costs will also be incurred. Heaters made for installation under the counter are designed to serve extremely hot water (approximately 80 to 85 degrees C.) for direct use in coffee, tea or soups without further heating. These heaters usually contain only a small volume of hot water (3 to 5 liters), and constitute a potential safety hazard due to their extreme temperature.

The recently patented Dual Mode Hot Water Circulation Apparatus (U.S. Pat. No. 5,331,996—26 Jul., 1994, to R. G. Ziehm) uses a cold water heat exchanger to induce a low rate convective circulation flow, plus an aspirator to supplement the convective flow with a higher rate circulation flow in response to water use in the building. This system yields excellent results, with hot water immediately available at any time, day or night. The length of the heat exchanger requires a space 1 to 1.5 meters long at an angle to the horizontal where the unit can be installed in the water supply pipe. This space may not always be available. Although the Dual Mode Hot Water Circulation Apparatus performs extremely well, material and manufacturing costs for it will be higher than for the present invention.

OBJECTS AND ADVANTAGES

The object of this invention is to provide instantly available hot water to remote faucets in residential or small commercial buildings. Additional objects and advantages of the present invention are as follows:

A. to provide a water circulation unit that conserves water and time;

B. to provide a water circulation unit that is responsive to user needs;

C. to provide a water circulation unit that is self regulating;

D. to provide a water circulation unit that is simple in design and operation;

E. to provide a water circulation unit that has high reliability;

F. to provide a water circulation unit that presents no safety hazard;

G. to provide a water circulation unit that needs no electrical power or gas;

H. to provide a water circulation unit that is quiet in operation;

I. to provide a water circulation unit that is easy to install;

J. to provide a water circulation unit that is economical to purchase;

K. to provide a water circulation unit whose hot water capacity is essentially equal to that of the water heater;

DETAILED DESCRIPTION OF THE INVENTION

Figure 1:
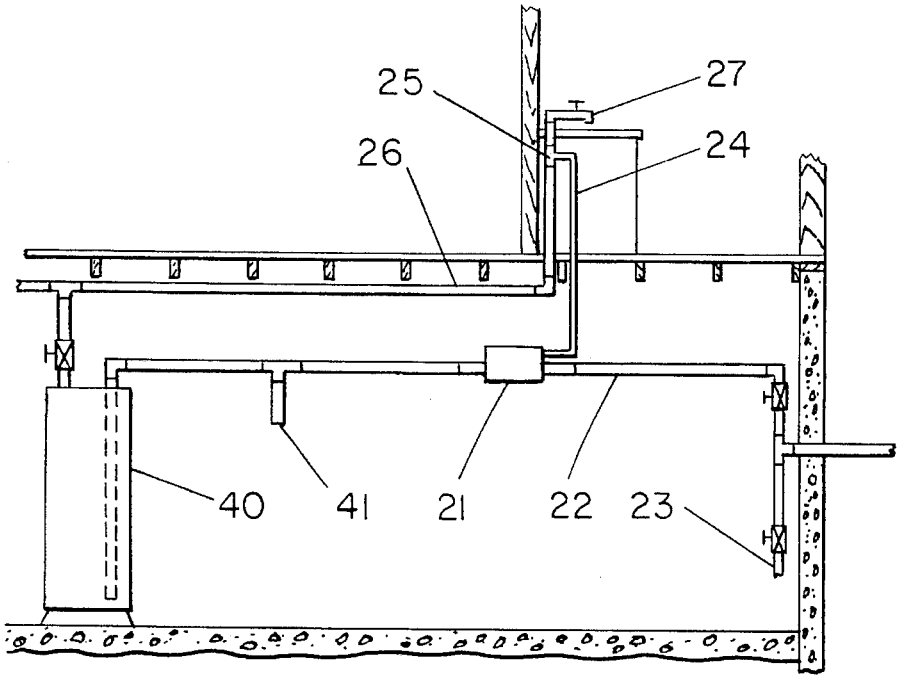
FIG. 1 shows a pictorial schematic of the aspirator water circulation unit in a typical residential installation.

This invention is a water circulation unit consisting of an aspirator and a check valve in a housing (body), and fittings for installation into the building cold water pipe and connection to a small water return line. Referring to FIG. 1, the water circulation unit 21 is installed in the building water supply pipe 22 downstream of the takeoff 23 for outside water outlets and lawn sprinkler systems. The water return line 24 leads from a tee 25 installed in the hot water pipe 26 (insulated for best performance) at the remote faucet 27, to a fitting on the circulation unit. The unit is capable of withstanding domestic water supply pressures. Each element of the unit is presented in more detail in the following paragraphs:

The water return line 24 is a small tube, nominally 1.0 cm outside diameter, of a length determined by each installation. It will typically be installed with flare or compression fittings.

Figure 2:
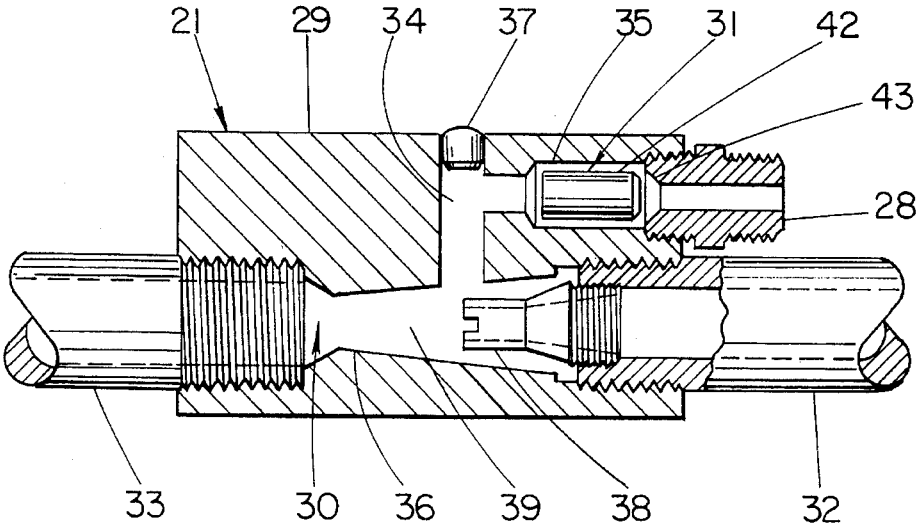
FIG. 2 shows a partially sectioned view of the aspirator water circulation unit.
Figure 3:
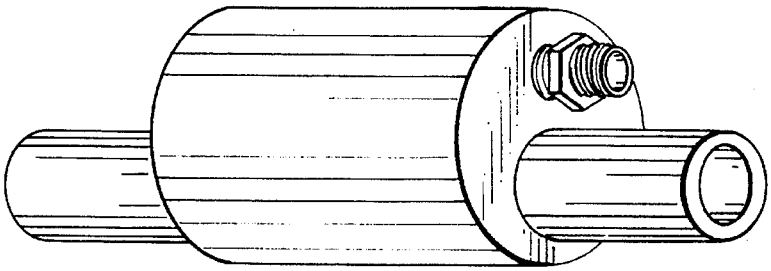
FIG. 3 shows the exterior configuration of the unit.

Referring now to FIG. 2, the body 29 is a cylindrical or similar shaped structure constructed of non-corrosive metal or plastic compatible with use in potable water systems, and may be cast, machined, or injection molded. The aspirator 30 and check valve 31 are integral to the body 29, each having a separate bore. The unit has inlet and outlet pipe nipples 32 and 33 respectively, compatible with installation in the cold water pipe in most domestic or small commercial buildings according to standard plumbing practices. An internal passageway 34 leads from the outlet end of the check valve bore 35 to the aspirator bore 36. This passageway is closed from the exterior by a plug 37 installed in the body 29. The following elements are located in or attached to the body 29:

1. Aspirator: The aspirator 30 is a tapered bore 36 in the body 29 with a conic section stainless steel nozzle 38 concentrically located in the large end of the bore. The nozzle is permanently installed in the inlet pipe nipple 32 that is threaded into the body 29, which properly positions it in the aspirator bore 36. The nozzle 38 presents a reduced cross section in the flow stream. The bore 36 forms the walls of a low pressure chamber 39 in the vicinity of the nozzle outlet. The passageway 34 in the body from the check valve 31 enters the aspirator bore 36 into the low pressure chamber 39. Referring back to FIG. 1, the unit is installed in the cold water supply pipe 22 with the nozzle end toward the water source, and the outlet end connected to the pipe leading to the water heater 40 and cold water outlets 41. The flow path is arranged so that all water for the building, except for outside water outlets and lawn sprinkler systems, passes through the nozzle.

2. Check Valve: Referring again to FIG. 2, the check valve 31 includes a poppet 42 that is free in a smooth, cylindrical, bore 35 in the body 29, and a concentric valve seat fitting 28 threaded into the body 29 at the inlet end of the bore 35. The poppet 42 has a cross section other than round, and a valve face on the inlet end that interfaces with the valve seat 43. The cross section of the poppet 42 is configured so that the flow area surrounding the poppet in the bore 35 has a cross sectional area equal to or larger than the inside area of the return line. The diameter of the internal passageway 34 creates a shoulder at the outlet end of the bore 35 that retains the poppet 42 in the bore. The poppet material has a specific gravity of 1.0 making it neutrally buoyant in water. The valve seat fitting 28 also includes provisions for attachment of the water return line on the end opposite the valve seat 43.

3: Fittings: Pipe nipples 32 and 33 that will connect to standard residential water piping are threaded into each end of the body 29, with the inlet nipple 32 configured to position and retain the aspirator nozzle 38. A tubing interface for connecting to the water return line is an integral part of the valve seat fitting 28.

4. Plug: The plug 37 closes the internal passageway 34 to the exterior.

OPERATION OF THE INVENTION

The unit establishes a hot water circulation flow any time that a faucet is open and water is flowing in the building. Referring now to FIG. 2, the circulation flow is caused by the aspirator 30 located internal to the circulation unit 21. The reduced cross section of the aspirator nozzle 38 causes a high velocity in the water passing through the nozzle. The high velocity water reduces the pressure in the low pressure chamber 39 of the aspirator bore 36. The opening of the internal passageway 34 into the aspirator bore 36 is located in this chamber. Referring to FIGS. 1 and 2, the low pressure causes water to be drawn through the return line 24, through the check valve 31, and into the main stream flowing to the water heater 40. This water is replaced by water from the heater 40 flowing through the hot water pipe 26 to the tee 25 at the remote faucet 27, thereby establishing the circulation loop, and providing hot water to the remote faucet.

Reverse flow in the water return line 24 is prevented by the check valve 31 integral to the circulation unit 21. The neutral buoyancy check valve poppet 42 is weightless in water, hence it has essentially zero friction in the bore 35, resulting in highly responsive performance without sticking. Flow through the check valve 31 from the inlet end occurs as differential water pressure causes the poppet 42 to move away from the seat 43 allowing water to flow around the poppet 42 in the cylindrical bore 35. Flow through the check valve 31 from the outlet end is not possible since the water will force the poppet 42 toward the inlet end, causing the poppet to bear against the valve seat 43, stopping the flow.

The unit produces a circulation flow rate sufficient to quickly provide hot water at the remote faucet with the use of a relatively small return line that makes for simple installation. The unit will maintain hot water at the remote faucet whenever there is normal frequency of water use in the building. With the return line tee installed on the most remote faucet on any hot water branch, the system will service all faucets on that branch. Tests conducted with the unit installed in a typical residential water system have revealed no objectionable reduction in flow capacity or other undesirable effects. The unit is self regulating since aspirator induced circulation flow occurs only when water is being used in the building, thereby conserving heat when hot water is not required.

It has been concluded from analyses and operational tests of a prototype aspirator water circulation unit, that it will perform in accordance with the stated objectives. Flow rates in the return line during typical water use at other water outlets have been measured in the range of 840 cubic cm/minute. This rate equates to replenishing the water in the hot water pipe at a linear rate of 2.5 meters/minute in a pipe with an inside diameter of 1.9 cm (0.75 inch). This rate will increase by the area ratio when dealing with smaller diameter water pipes. The minimum useful hot water temperature compatible with most household uses has been determined to be about 32 degrees C. With water use in the building of five gallons at one hour intervals, water temperature in the hot water pipe near the remote faucet has been measured to stay at or above 32 degrees C. Upon opening the remote faucet, heater temperature water is quickly available since the water pipe is already heated, and heater temperature water has progressed part of the distance due to the return line flow resulting from other water use in the building. Test results have shown that following periods of no water use in the building, the aspirator water circulation unit will reduce the time required to bring useful hot water to the remote faucet by approximately 80% from the as-built water system configuration. The unit is noiseless, except for a minor click as the check valve closes when the remote water faucet is opened.

The above operational discussion has identified and defined several advantages inherent in the present invention as follows:

A. The unit will quickly provide hot water to a remote faucet in response to user needs.

B. The unit will quietly replenish hot water in the pipe to the remote faucet each time water is used anywhere in the building.

C. Water will be conserved since there will be no need to run water to waste while waiting for hot water to reach the remote faucet.

D. Heat will not be wasted when no one is in the building or at night, since the unit responds only to water use in the building.

E. The unit is self regulating, responding to water use in the building which indicates potential hot water needs.

F. The design concept utilizes a simple, proven approach to draw water through the circulation loop.

G. The unit is economical to operate, using no electrical power or gas.

H. The installation is simple and requires minimal space.

I. The return line is a small tube making for easy installation.

J. Since there is only one moving part, reliability is high with no periodic maintenance required.

K. Water temperature never exceeds the temperature of the water heater, avoiding a safety issue inherent in high temperature undersink heating units.

L. Hot water capacity is limited only by the capacity of the building water heater.

SUMMARY OF INVENTION

This invention is a passive, self-regulating water circulation apparatus, that will circulate water from the heater, to the remote faucet, through a small return circulation line and the circulation unit, and back to the heater, for the purpose of keeping hot water at remote faucets when water use in the building signals a potential need for hot water. The circulation is induced by an aspirator installed in the water supply line to the building water heater and cold water outlets. The aspirator operates at any time that water is being used in the building, and replenishes the hot water in the pipe leading to the remote faucets. The unit also includes a neutral buoyancy check valve to prevent reverse flow in the water return line. It is primarily intended for use in residential and/or small commercial buildings. The aspirator water circulation unit offers the following unique and novel features:

A. Use of an aspirator in the generation of a circulating flow between the water heater and a remote hot water faucet for the purpose of quickly bringing and maintaining heated water to the remote location.

B. A check valve with a neutral buoyancy poppet to eliminate gravity effects and resulting friction between the poppet and the wall of the bore.

C. A small return circulation line that can be installed with the most convenient routing for each installation.

Other embodiments of the invention from that shown and described here are possible, as well as different arrangements of the unit in the building water system. The scope of the invention should not be determined by the configuration shown here, but by the stated claims herein.

I claim:

1. A method for providing the instantaneous flow of hot water from any one of a plurality of hot water faucets in a building when opened, the method comprising:

providing a cold water supply line for supplying cold water to the building;

providing a water heater having an inlet coupled to the cold water supply line for receiving cold water and having an outlet for discharging hot water;

providing a hot water supply line coupled to the outlet of the water heater, into which hot water is discharged from the water heater for distribution to said plurality of hot water faucets in the building;

providing a cold water tap in said cold water supply line, said cold water tap being located upstream of said water heater for distributing cold water to a plurality of cold water faucets positioned in the building;

providing an integral aspirator/check valve assembly coupled in the cold water supply line upstream of said cold water tap, said integral aspirator/check valve assembly having a cold water inlet for receiving cold water from the cold water supply line, having a cold water outlet through which cold water flows back into the cold water supply line, and having a return water inlet; and providing a return water line, one end of which is coupled to said hot water supply line proximate a most remotely located one of said plurality of hot water faucets and the other end of which is coupled to said return water inlet of said integral aspirator/check valve assembly, said return water line being of a selected diameter smaller than said hot water supply line such that a fraction of a volume of hot water available at said most remotely located one of said plurality of hot water faucets flows to said integral aspirator/check valve assembly through said return water line when cold water flows through said integral aspirator/check valve assembly.

2. A hot water circulation system for providing instantaneous hot water to a plurality of hot water faucets in a building, the hot water circulation system comprising:

a cold water supply line for supplying cold water to the building;

a water heater having an inlet coupled to the cold water supply line for receiving cold water and having an outlet for discharging hot water;

a hot water supply line coupled to the outlet of the water heater, into which hot water is discharged from the water heater for distribution to said plurality of hot water faucets in the building;

a cold water tap in said cold water supply line, said cold water tap being located upstream of said water heater for distributing cold water to a plurality of cold water faucets positioned in the building;

an integral aspirator/check valve assembly coupled in the cold water supply line upstream of said cold water tap, said integral aspirator/check valve assembly having a cold water inlet for receiving cold water from the cold water supply line, having a cold water outlet through which cold water flows back into the cold water supply line, and having a return water inlet; and a return water line, one end of which is coupled to said hot water supply line proximate a most remotely located one of said plurality of hot water faucets and the other end of which is coupled to said return water inlet of said integral aspirator/check valve assembly, said return water line being of a selected diameter smaller than said hot water supply line such that a fraction of a volume of hot water available at said most remotely located one of said plurality of hot water faucets flows to said integral aspirator/check valve assembly through said return water line when cold water flows through said integral aspirator/check valve assembly.

3. A hot water circulation system as in claim 2, wherein said integral aspirator/check valve assembly comprises:

a check valve positioned to receive a flow of hot water from said return water line;

a nozzle positioned in a flow path of cold water through said integral aspirator/check valve assembly;

a reduced pressure chamber located at an outlet end of said nozzle; and a port coupling said reduced pressure chamber to an outlet of said check valve.

4. A hot water circulation system as in claim 3, wherein said check valve includes a closure poppet having a resultant weight per unit volume equal to that of water.

* * * * *